United States Patent [19]

Della-Porta et al.

[11] 4,198,894

[45] Apr. 22, 1980

[54] BASS DRUM PEDAL

[75] Inventors: Clifford A. Della-Porta; Peter J. F. B. Spenlove-Spenlove, both of Leicester, England

[73] Assignee: The Premier Drum Company Limited, Leicester, England

[21] Appl. No.: 826,347

[22] Filed: Aug. 22, 1977

[30] Foreign Application Priority Data

Aug. 27, 1976 [GB] United Kingdom ..... 35674/76

[51] Int. Cl.[2] ..... G10D 13/00
[52] U.S. Cl. ..... 84/422 R
[58] Field of Search ..... 84/422 R

[56] References Cited

U.S. PATENT DOCUMENTS

| | | | |
|---|---|---|---|
| 1,804,128 | 5/1931 | Strupe | 84/422 R |
| 2,132,211 | 10/1938 | Hueckstead | 84/422 R |
| 2,584,554 | 2/1952 | Clayton | 84/422 R X |
| 3,742,810 | 7/1973 | Crigger | 84/422 R |

*Primary Examiner*—Lawrence R. Franklin
*Attorney, Agent, or Firm*—Spensley, Horn, Jubas & Lubitz

[57] ABSTRACT

The invention provides in a pedal for a bass drum having a foot plate which is returned to its rest position by a compression spring, the improvement whereby guide means are provided to constrain the said spring from buckling during its compression and relaxation.

2 Claims, 2 Drawing Figures

BASS DRUM PEDAL

BACKGROUND OF INVENTION

The present invention relates to a pedal for a bass drum.

It is known to provide a pedal for a bass drum comprising a foot plate pivoted to a base, from which extends support means carrying an arm extending over the said foot plate; a beater crank pivotally mounted on said arm, said beater crank bearing attachment means by which a shank portion of a beater head is receivable, said beater crank also being connected by means of a linkage to a toe portion of the said foot plate; a mechanism for returning the foot plate to its rest position; and a clamp enabling the pedal to be releasably attached to a bass drum.

In use, a musician depresses the foot plate to bring down the linkage and so rotate the beater crank, swinging the head of a beater against a drum.

Usually the linkage between the foot plate and the beater crank is provided by a flexible strap of any suitable material, especially nylon, the strap extending between the toe portion of the foot plate and the beater crank.

The beater crank is usually provided with a socket within which the shank of a beater head may be received, the shank being retained in the socket by means of a thumb screw provided in the socket wall.

The clamp fixing may comprise a screw clamp mounted on the base of the pedal, the clamp being provided with jaws co-operable with a rim of a bass drum.

The base conveniently comprises two base elements adjustably articulated one with the other, one of the elements pivotally mounting the foot plate and the other element mounting the support means.

The support means is usually provided by one or more 'posts' upstanding from the base.

A number of pointed adjustable screws may be provided in the base so that the pedal may be releasably secured against lateral movement, to a floor.

It is usual to provide a tension spring to return the foot plate to its rest position, the said tension spring being loaded as a result of the depression of a foot plate by a musician. It has been found, however, that such springs are liable to strain, breakage and fatigue and to avoid these shortcomings use has occasionally been made of one or more compression springs to return the foot plate to the rest position.

In order to obtain sufficient sensitivity of control of the drum beat it has been found necessary to use a compression spring of substantial length the disadvantage of this arrangement being that such springs are liable to buckle in use.

BRIEF SUMMARY OF INVENTION

It is an object of this invention to provide a pedal for a bass drum which overcomes the above disadvantage.

The invention provides therefore a pedal for a bass drum, in which a compression spring is operatively linked to the foot plate and mounted in relation to the base so as to be compressed upon depression of the foot plate, guide means being provided by which the compression spring is constrained from buckling during its compression and relaxation.

In a preferred embodiment, the invention provides a pedal for a bass drum, in which the guide means comprises a substantially rigid rod upon which the compression spring is mounted in the manner of a sleeve, the said rigid rod being provided with abutment means against which one end of the compression spring abuts, an opposite end of the said spring abutting a stop provided on the support means.

Provision may be made for preloading the compression spring. In this arrangement the stop member is adjustable and pivotally mounted, being provided with an opening of a size large enough to permit a lower portion of the rigid rod to pass therethrough but too small to permit the said opposite end of the compression spring to pass therethrough.

The stop member may suitably be retained in a given position by means of a set-screw.

The compression spring and rigid rod are preferably housed inside the support means which comprises a single hollow post.

BRIEF DESCRIPTION OF THE DRAWINGS

There will now be described an example of a pedal for a bass drum according to the invention. It is to be understood that the description, which is to be read with reference to the accompanying drawings, is given by way of example only and not by way of limitation.

In the drawings.

Figure 1:
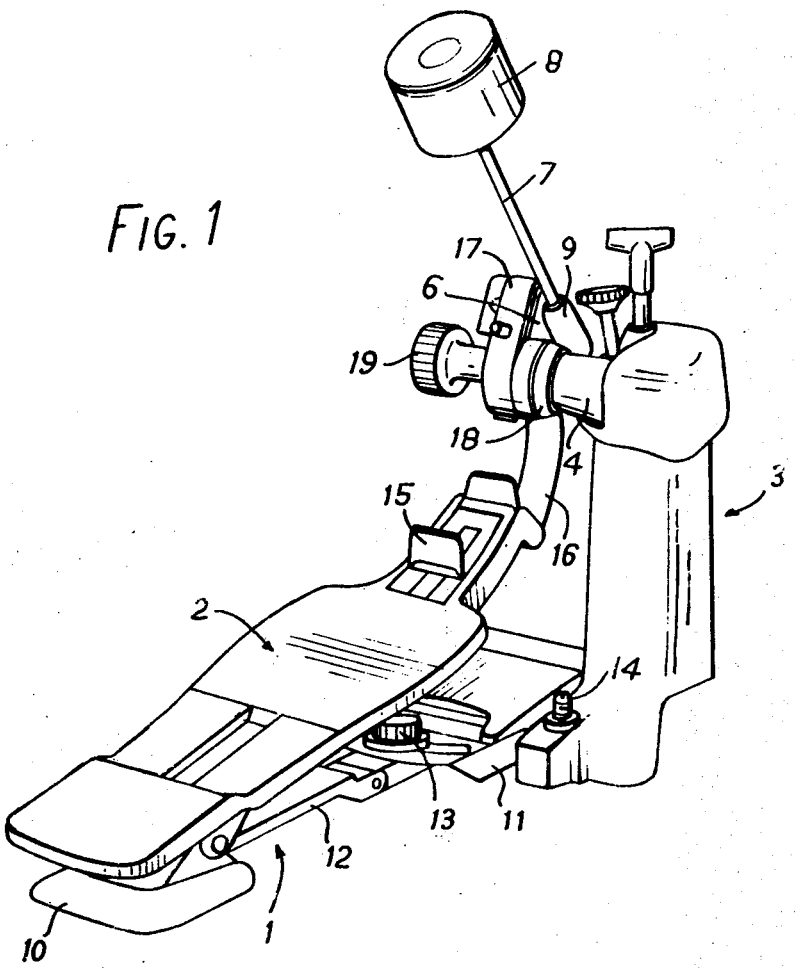
FIG. 1 is a perspective view of a pedal for a bass drum according to the invention.

In the drawings the reference numeral 1 generally indicates a base, 2 a foot plate, 3 a post, 4 an arm mounted on a post, 5 (see FIG. 2) an axle rotatable in the arm 4, 6 a beater crank mounted on the axle 5, and 7, a shank of a beater head 8, secured in a socket 9, on the beater crank 6.

The base 1, is made up of two elements articulated one to the other, these being foot section 10, and a forepart 11, connected through an adjusting link 12. The link is arranged so that the foot section 10, may be aligned at an angle to the forepart 11, and clamped in that position by means of a clamping screw 13.

Pointed screws 14, are threadingly engaged in threaded bores provided in the forepart 11, of the base 1. These screws when tightened bite into a floor on which the pedal is resting to secure the pedal against lateral movement.

The foot plate is of convention design and is provided with an adjustable toe stop 15, of known type.

The foot plate 2, is connected by means of a flexible nylon strap 16, to the beater crank 6, whereon it is secured by means of a clamping plate 17.

The radial position of the beater crank 6, on the axle 5, (see FIG. 2) is adjustable by means of a dog-clutch 18, the operative parts of which are held in contact by means of a cap nut 19. The position of the beater crank on the axle 5, determines the distance of the beater head 8, from the bass drum at rest, and also, for a given length of the strap 16, the inclination of the foot plate 2, at rest.

Figure 2:
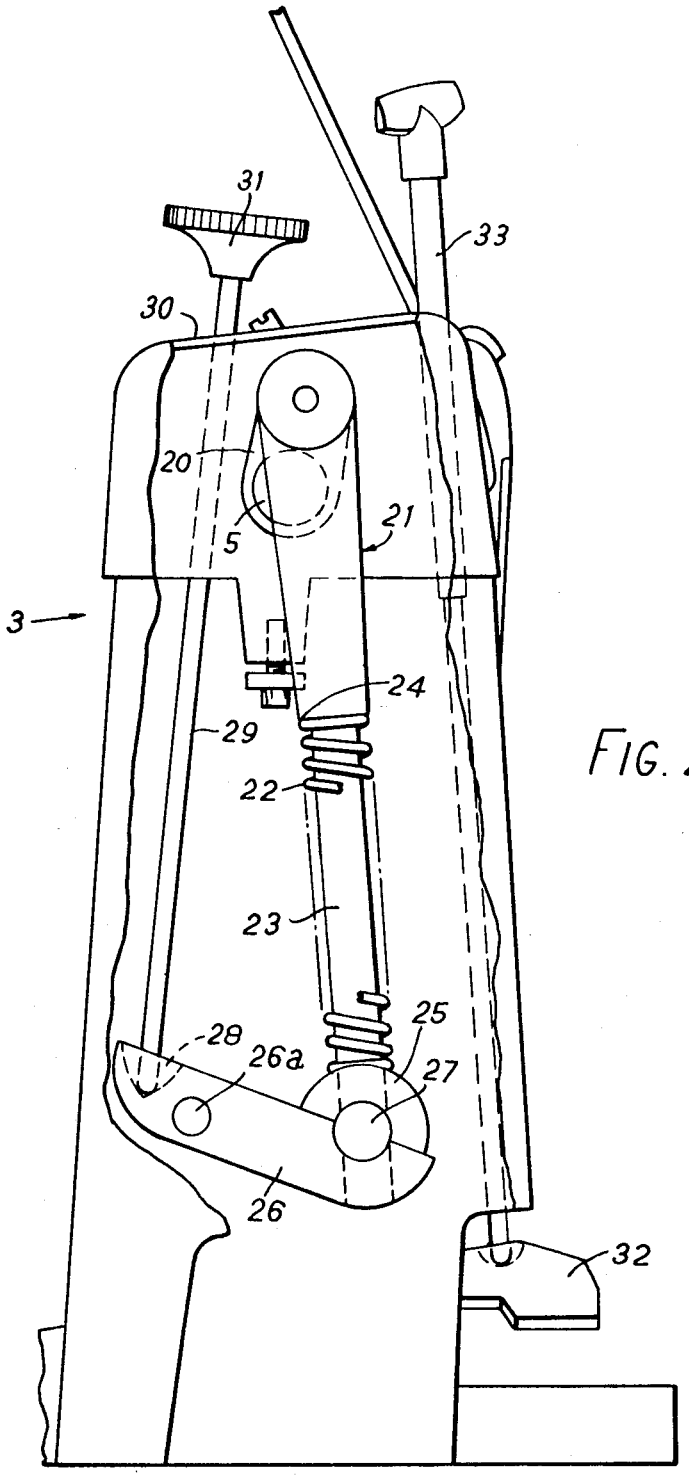
FIG. 2 is a side elevational view of a portion of the pedal shown in FIG. 1 shown partially cut away to reveal a compression spring assembly, and other working parts.

In FIG. 2 the axle 5, carries an end thereof within the post 3, a crank member 20, which at its outer and upper end has pivotally secured thereto a rigid rod 21.

The rod 21, has an extension portion of reduced section 23, at a lower end thereof, which forms a guide for a compression spring 22. One end of the compression spring abuts a shoulder 24, at one end of the reduced portion 23. An opposite end of the compression spring 22, rests in a bore provided in a bearing element 25, which is rotatably supported in a cradle 26, by means of a spindle 27, the cradle itself being pivotally mounted by means of a pivot 26a on the body of the post 3.

A lower end of the extension portion 23, of the rod 21, passes through an opening in the spindle 27, supporting the stop member 25, the said opening being too small to allow passage of the lower end of compression spring 22, therethrough.

At an end remote from the stop member 25, the cradle 26, is furnished on an upper surface thereof with a recess 28, which receives the rounded end of plunger 29, threaded in a top plate 30, of post 3. The plunger 29 is provided with a head 31, and is thus adjustable as a set screw to vary the angle of the cradle 26, and hence the vertical position of the stop member 25, so varying the pre-compression of the spring 22. Thus the spring may be pre-loaded as desired.

FIG. 2 also shows a jaw 32 which may be moved to and from the base 1, by means of a screwed rod 33, enabling the rim of a drum to be clamped between the said jaw and base 1, the said base acting as a second jaw complementary to the jaw 32.

Prior to use, the rim of a bass drum (not shown) is inserted between the forepart of the base 11 and the jaw 32 whereupon the screwed rod 33 is tightened, so clamping the pedal to the rim.

In use, a musician depresses the foot plate 2 with his foot whereupon the foot plate pivots about the foot section 10 of the base. The strap 16 is pulled downward and so rotates the beater crank 6 on the axle 5, pivoting the beater head 8 against a head of the drum (not shown).

The pivoting of the axle 5 causes the crank member 20 to rotate, pushing a lower end of the reduced portion 23 of the rigid rod 21 through the bore provided in the bearing element 25. The spring 22 is thus compressed between the shoulder 24 and the perimeter of the bore in the bearing element 25.

Relaxation of the musicians foot causes the foot plate 2 to be returned to its rest position under the influence of the spring 22.

The pre-compression of the spring 22 may be adjusted by means of the plunger 29 which may be screwed down or up to pivot the cradle 26 about the pivot 26a. Thus the bearing member may be moved towards or away from the shoulder 24 of the rigid rod 21, so adjusting the degree of compression of the spring 22 in its 'rest' position.

Whilst the preferred embodiment of the invention has been illustrated and described herein it will be apparent to those skilled in the art that various modifications and improvements may be resorted to without departing from the spirit and scope of the invention.

We claim:

1. In a pedal for a bass drum having a base; a food plate pivotally coupled to said base; support means extending from said base and an arm extending from said support means over said foot plate; a beater crank pivotally mounted on said arm; attachment means provided on said beater crank, said attachment means for receiving a shank portion of a beater head; a linkage extending between a toe portion of said foot plate and said beater crank; a compression spring operatively coupled to said foot plate and mounted in relation to the said base so as to be compressed upon depression of said foot plate, the improvement comprising a rigid rod in contact with said compression spring such that said compression spring is constrained from buckling during its compression and relaxation, said rod acting as a sleeve for said compression spring, and wherein said rod has abutment means against which one end of said compression spring abuts, said compression spring being slideable relative to a stop member disposed on the support means against which the other end of the compression spring abuts, said stop member being adjustable so as to permit regulation of the degree of compression of said compression spring, and further wherein said stop member is pivotally mounted on said support means and comprises a member having a bore therein large enough to permit a lower portion of said rod to pass therethrough but too small to allow a lower end of said compression spring to pass therethrough.

2. A pedal as set forth in claim 1 wherein a set screw is provided to retain said stop member in a given position.

* * * * *